US008657219B2

(12) United States Patent
Sato

(10) Patent No.: US 8,657,219 B2
(45) Date of Patent: Feb. 25, 2014

(54) SHEET WASTE PROCESSING DEVICE, IMAGE FORMING APPARATUS, AND SHEET WASTE PROCESSING METHOD

(75) Inventor: Ryuichi Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 825 days.

(21) Appl. No.: 11/938,826

(22) Filed: Nov. 13, 2007

(65) Prior Publication Data

US 2008/0111299 A1 May 15, 2008

(30) Foreign Application Priority Data

Nov. 14, 2006 (JP) ..... 2006-308172

(51) Int. Cl.
*B02C 23/00* (2006.01)
*B26D 7/06* (2006.01)

(52) U.S. Cl.
USPC ..... 241/100; 241/222; 83/156

(58) Field of Classification Search
USPC ..... 241/100, 222, 274; 83/156
See application file for complete search history.

(56) References Cited

U.S. PATENT DOCUMENTS

| | | | | |
|---|---|---|---|---|
| 4,923,126 | A * | 5/1990 | Lodovico et al. | 241/30 |
| 5,188,301 | A * | 2/1993 | Hasegawa | 241/33 |
| 5,538,193 | A * | 7/1996 | Takahashi et al. | 241/33 |
| 7,413,360 | B2 | 8/2008 | Kikuchi | |
| 7,461,578 | B2 | 12/2008 | Tamura et al. | |
| 2004/0259706 | A1 * | 12/2004 | Ueda et al. | 492/30 |
| 2004/0265714 | A1 * | 12/2004 | Miyakawa et al. | 430/45 |
| 2005/0115377 | A1 | 6/2005 | Kobayashi | |
| 2005/0280668 | A1 * | 12/2005 | Otsuki | 347/43 |
| 2008/0112018 | A1 | 5/2008 | Sato | |

FOREIGN PATENT DOCUMENTS

| | | | | |
|---|---|---|---|---|
| DE | 3510632 | A1 * | 9/1986 | B02C 18/44 |
| JP | 63-050697 | U | 4/1988 | |
| JP | 404135656 | * | 5/1992 | |
| JP | 2001-300334 | A | 10/2001 | |
| JP | 2001-300339 | A | 10/2001 | |
| JP | 2003-260834 | A | 9/2003 | |
| JP | 2004-331328 | A | 11/2004 | |
| JP | 2006-199428 | A | 8/2006 | |

OTHER PUBLICATIONS

U.S. Appl. No. 11/938,544, entitled Sheet Processing Device, and Image Forming Apparatus Including an Waste Receiver and an Auxiliary Receiver and filed Nov. 12, 2007.
Japanese Office Action issued on May 10, 2011 in the corresponding Japanese Patent Application No. 2006-308166.
Notification of Reason for Refusal issued on Jul. 26, 2011 in counterpart Japanese Application No. 2006-308172.
Japanese Office Action issued in corresponding Japanese Patent Application No. 2006-308172 on Apr. 19, 2011.

* cited by examiner

*Primary Examiner* — Faye Francis
(74) *Attorney, Agent, or Firm* — Sughrue Mion, PLLC

(57) ABSTRACT

A sheet waste processing device includes: a sheet processing tool that generates piece-like sheet wastes by processing for sheets; a waste receiver that is provided freely movably under the sheet processing tool between a setting position where the sheet wastes generated by the sheet processing tool are housed and a non-setting position where the sheet wastes housed are disposed of; and a transporting/guarding member that is provided between the sheet processing tool and the waste receiver, transports the sheet wastes into the waste receiver located at the setting position, and blocks direct touching the sheet processing tool from a waste receiver space generated by movement of the waste receiver under the condition that the waste receiver is moved to the non-setting position.

6 Claims, 9 Drawing Sheets

SHEET WASTE PROCESSING DEVICE, IMAGE FORMING APPARATUS, AND SHEET WASTE PROCESSING METHOD

CROSS-REFERENCE TO RELATED APPLICATIONS

This application is based on and claims priority under 35 U.S.C. 119 from Japanese Patent Application No. 2006-308172 filed Nov. 14, 2007.

BACKGROUND

1. Technical Field

This invention relates to a sheet waste processing device which is employed in an image forming apparatus such as a copying machine or printer, and more particularly to a sheet waste processing device having a sheet waste generating unit capable of generating sheet wastes and an image forming apparatus using it.

2. Related Art

In recent years, with development of "on-demand publishing", has been widely used the image forming apparatus such as an "in-line type" of copying machine or printer equipped with a center-binding function and a cutting function for making a booklet in addition to an image forming function.

Such an apparatus is provided with a cutting device serving as a sheet waste processing device in which the edges (e.g. cut ends) of a booklet are cutting-finished so as to be finely trimmed in order to complete the booklet. The sheet wastes generated by cutting are taken in a housing vessel within the cutting device and appropriately disposed of.

SUMMARY

According to an aspect of the present invention, a sheet waste processing device includes: a sheet processing tool that generates piece-like sheet wastes by processing for sheets; a waste receiver that is provided freely movably under the sheet processing tool between a setting position where the sheet wastes generated by the sheet processing tool are received and a non-setting position where the sheet wastes received are disposed of; and a transporting/guarding member that is provided between the sheet processing tool and the waste receiver, transports the sheet wastes into the waste receiver located at the setting position, and blocks direct touching the sheet processing tool from a waste receiver space.

BRIEF DESCRIPTION OF THE DRAWINGS

Exemplary embodiment of the present invention will be described in detail based on the following figures, wherein.

DETAILED DESCRIPTION

Figure 1:
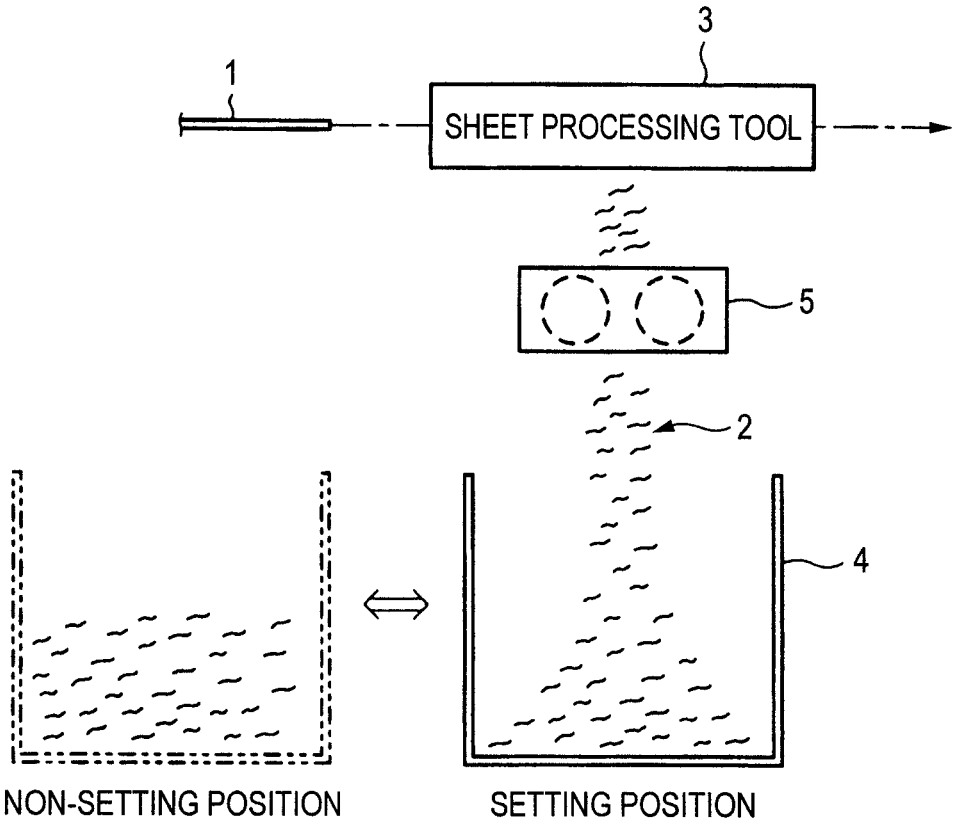
FIG. 1 is a view for explaining the schematic configuration of a sheet waste processing device according to this invention.

On the basis of an embodiment shown in the drawings attached herewith, a detailed explanation will be given of typical modes of this invention.

Figure 2:
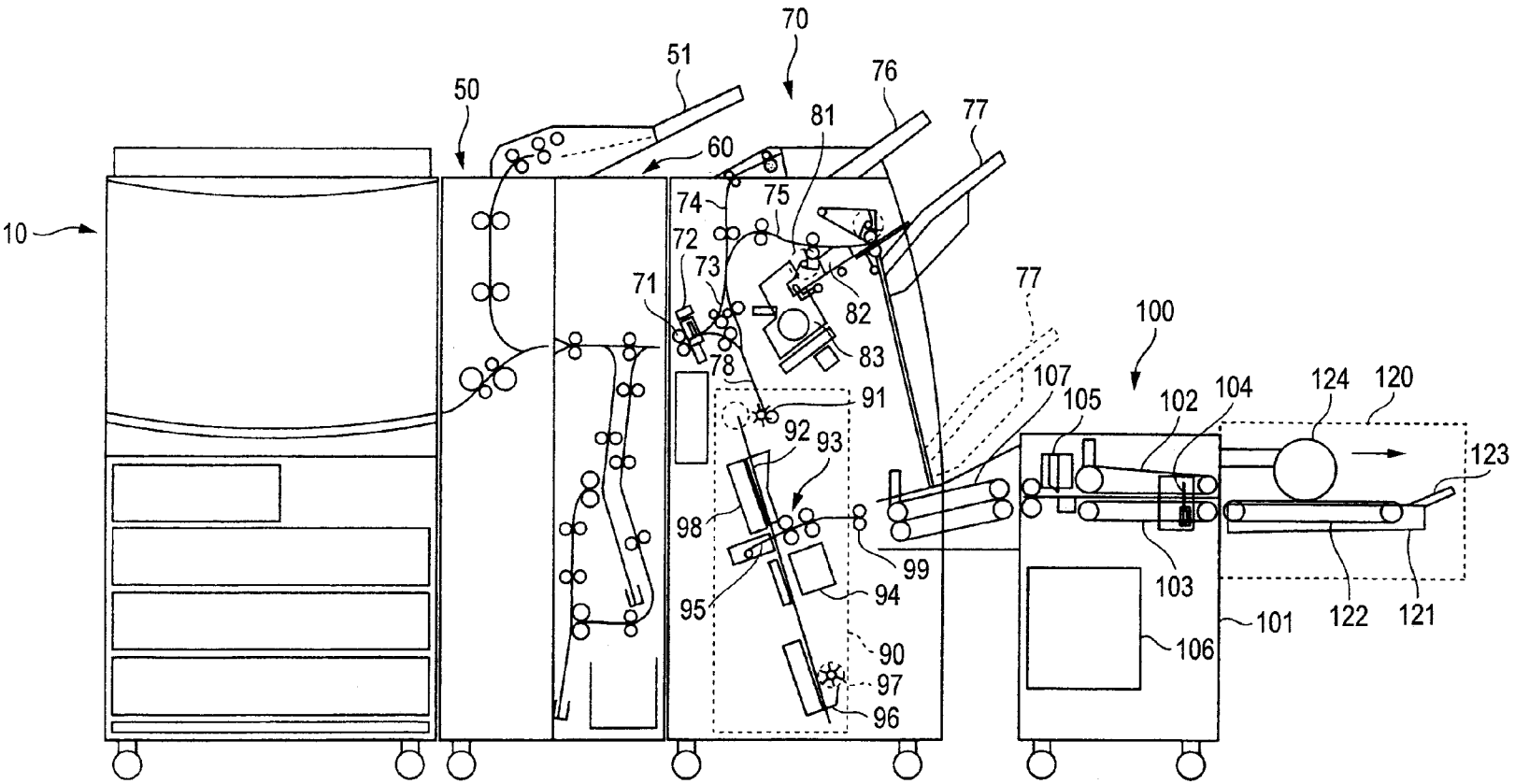
FIG. 2 is a view for explaining a printing device according to an embodiment to which this invention is applied.

FIG. 2 shows a printing device serving as an image forming apparatus including a sheet waste processing device according to an embodiment to which this invention is applied.

In FIG. 2, reference numeral 10 denotes a digital copying machine serving as the image forming apparatus. Images are formed on sheets by the digital copying machine 10. The sheets with the images formed thereon are subjected to several kinds of processing. On the downstream side of the digital copying machine 10, therefore, combined therewith is a post-processing device 70 which executes post-processing such as binding processing, hole-making (punching) processing and center-binding/center-folding for the sheets. Arranged between the digital copying machine 10 and the post-processing device 70 are an inverted-transporting device 50 for inverted-transporting the sheet and a sheet stand-by device 60 for causing sheets to stand by as the occasion demands.

Further, in this embodiment, arranged on the downstream side of the post-processing device 70 are a cutting device 100 for finish-cutting a bundle of sheets in a booklet form center-bound and center-folded by the post-processing device 70 and a housing tray 120 for housing the bundle of sheets (booklet) cut by the cutting device 100.

Figure 3:
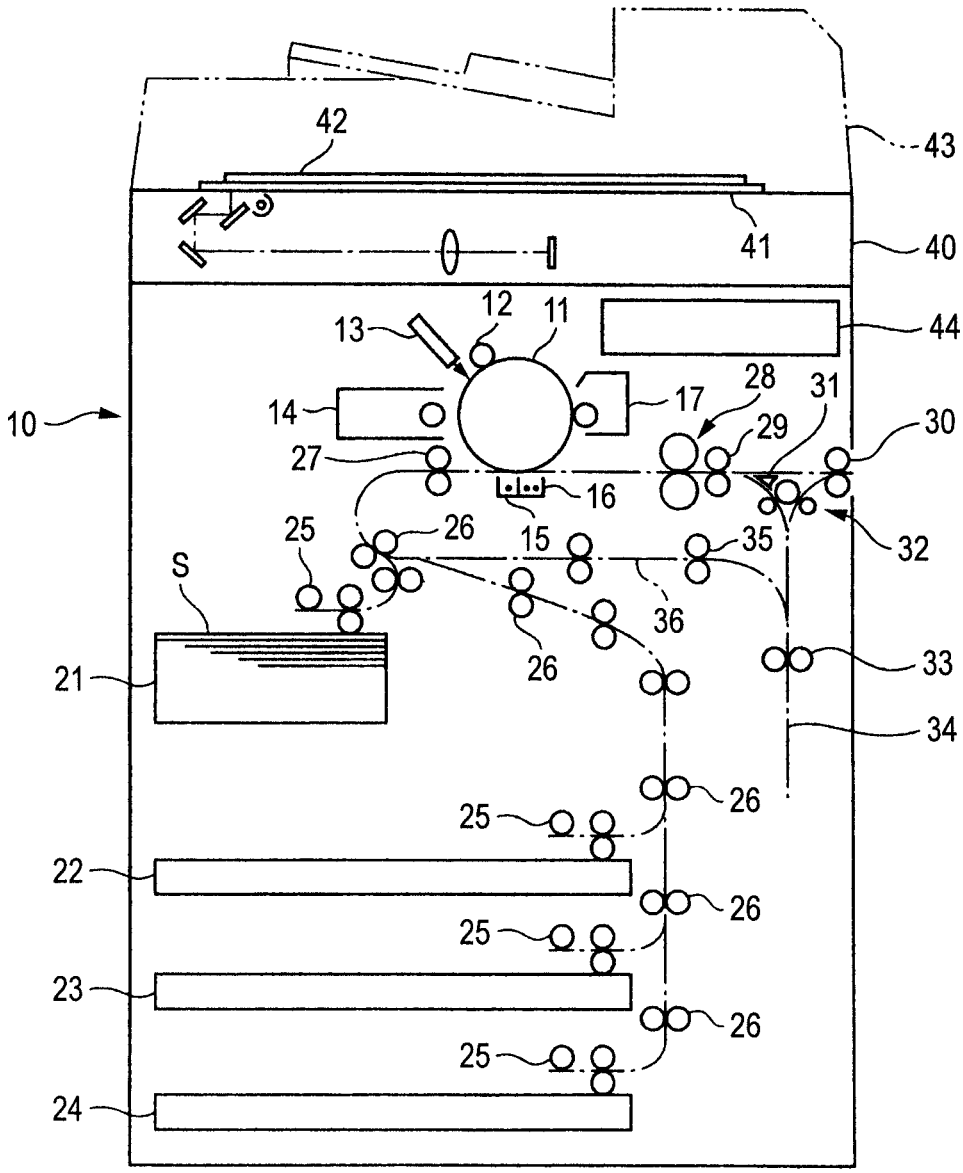
FIG. 3 is a view for explaining a digital copying machine according to the embodiment.

The digital copying machine 10 in this embodiment is configured as shown in FIG. 3. As seen from FIG. 3, on its upper side, the digital copying machine 10 includes an image reading device 40 for reading the image of a document 42 set on a platen glass 41. Beneath the image reading device 40, an image forming unit is provided. The image forming unit creates a toner image on a photosensitive body 11 and transfers the toner image thus created onto a sheet S transported by feeding roll 25 from plural sheet-feeding cassettes 21 to 24 arranged below the image forming unit.

Therefore, arranged around the photosensitive body 11 are a charger 12 such a charging roll for uniformly charging the photosensitive body 11, a light-exposing device 13 such as a laser scanner for forming a latent image on the photosensitive body 11 charged, a developing device 14 for visually imaging the latent image on the photosensitive body 11, a transferring device 15 such as a colotron for transferring the toner image created on the photosensitive body 11 onto the sheet S fed from each of the feeding cassettes 21 to 24 and a cleaner 17 for cleaning the toners remaining on the photosensitive body 11 after transfer. Reference numeral 16 denotes an ionizer for separating the sheet S after the toner image is transferred from the photosensitive body 11. Reference numeral 44 denotes an image information processing unit for processing the image information of the document 42 read by the image reading device 40. Reference numeral 43 indicated in two-dot chain line denotes an automated document feeding device, which is an optional device, for feeding the document 42 onto the platen glass 41.

Further, the sheet transporting system in this digital copying machine 10 is constructed as follows. In the vicinity of the sheet feeding cassettes 21 to 24, feeding rolls 25 for feeding the sheet S from each of the feeding cassettes 21 to 24 are provided. The sheet S fed by the feeding rolls 25 is transported by transporting rolls 26 arranged as required and guided to resist rolls 27 on the upstream side of the photosensitive body 11. The resist rolls 27 control the positioning of the sheet to transport, at a predetermined timing, the sheet to an area where the photosensitive body 11 and the transferring device 15 are opposite to each other.

The sheet subjected to transfer is transported to a fixer 28 in which the non-fixed toners on the sheet are fixed by e.g. heating and pressurizing. The sheet subjected to fixing is guided from exit roll 29 of the fixer 28 to ejecting roll 30 and transported to the device on the downstream side (inverted-transporting device 50 in this embodiment).

On the other hand, where images are to be created on both sides of the sheet, the sheet passed the exit roll 29 of the fixer 28 is changed downward in its transporting direction by an inverting gate 31 and guided to an inverted-transporting path 34 through a tri-roll 32 composed of three roles arranged in pressure-contact and inverting rolls 33. The sheet reached the inverted-transporting path 34 is transported to a return transporting path 36 with transporting rolls 35 by the inverting operation of the inverting rolls 33 under the condition that the rear end of the sheet is sandwiched by the inverting rolls 33. The sheet transported to the return transporting path 36 is given an image on the rear surface by the charge transfer 15 via the resist rolls 27 and thereafter subjected to fixing by the fuser 28. The sheet subjected to the fixing is transported to the device on the downstream side via the exit roll 29 and ejecting roll 30.

In this way, the sheet with the image created by the digital copying machine 10, as shown in FIG. 2, is guided by the inverted-transporting device 50 or the sheet stand-by device 60 so that it is inverted-ejected to an ejecting tray 51 provided above or transported to the succeeding post-processing device at a predetermined timing by the sheet stand-by device 60.

The post-processing device 70 in this embodiment is provided with transporting rolls 71 for transporting the sheet fed from the sheet stand-by device 60 at the inlet and a puncher 72 for punching located immediately behind it. On the downstream side of the puncher 72, the sheet transporting path is branched. An upper sheet transporting path 73 is further branched into a sheet transporting path 74 along which the sheet, as it is, guided to an ejecting tray 76 provided above the post-processing device 70 and a sheet transporting path 75 along which the sheet after edge-bound is ejected to an offset catch tray 77. Therefore, the sheet transporting paths 73, 74 and 75 are appropriately provided with transporting rolls for sheet transportation and sensors, respectively.

Further, the sheets transported to the sheet transporting path 75 are lined up by a paddle 81 and a tamper 82 and thereafter bound in their sheet edges by a stapler 83 and ejected onto the offset catch tray 77. The offset catch tray 77 is adapted to automatically move downward as the number of the bundles of sheets increases.

On the other hand, a sheet transporting path 78 branched downward from the puncher 72 is provided with a center-binding processing device 90 for making a booklet composed of plural sheets.

The center-binding processing device 90 is provided with a sheet aligning tray 92 slanted on the skew. On the upstream side thereof, paddle-equipped transporting rolls 91 located for transporting the sheet to the sheet aligning tray 92 is located. At the lower end of the sheet aligning tray 92, an end guide 96 for positioning the lower end (tip) of the sheet at a predetermined position is provided so that it can move along the vertical direction of the sheet aligning tray 92. Further, in the vicinity of the end guide 96, a paddle 97 for aligning the lower ends of the sheets is provided.

Further, at the upper end of the sheet aligning tray 92, a damper (not shown) for aligning the ends in the width direction of the sheets arranged on the sheet aligning tray 92 is provided. A damper driving unit 98 for driving the damper is provided.

Thus, the sheets transported from the sheet transporting path 78 to the center-binding processing device 90 are aligned every plural sheets by the sheet aligning tray 92 via the paddle-equipped transporting roll 91.

Further, the center binding processing device 90 is also provided with a center-binding saddle stapler 94 for center-binding a bundle of plural sheets lined up on the sheet aligning tray 92. Above the saddle stapler 94, a knife wedge 95 for center-folding the bundle of the plural sheets center-bound is movably provided oppositely to a pair of center-folding roll 93. Thus, by moving the end guide 96, the plural sheets lined up on the sheet aligning tray 92 are center-bound by the saddle stapler 94. By moving the knife wedge 95 toward the pair of the center-binding rolls 93, the sheet bundle center-folded is transported with the center fold being at the head from an ejecting roll 99 to the succeeding cutting device 100.

Further, in this embodiment, between the cutting device 100 and the post-processing device 70, belt transporters 107 circulating in a pair configuration are provided. The sheet bundle created as the booklet by the post processing device 70 is sandwich-transported by the belt transporter 107 and thereafter guided to a device body 101 of the cutting device 100. Within the device body 101 of the cutting device 100, transporting belts 102, 103 in the pair configuration for the sandwich-transporting the sheet bundle in the booklet form are provided as e.g. two sets of parallel belts in a direction nearly perpendicular to the transporting direction. Between the belts, a stopper 104 for positioning the tip (center fold of the booklet) is provided. The stopper 104 can advance or retreat, for example, from below for the sheet bundle transporting plane.

Therefore, after the sheet bundle in the booklet form which being sandwiched by the transporting belts 102, 103 is positioned by the stopper 104, it is cutting-finished in its rear end in such a manner that a knife 105 serving as a sheet processing tool located on the upstream side of the stopper 104 descends.

In this case, the sheet wastes generated owing to cutting by the knife 105 are housed in a waste receiving box 106 which is a waste receiver mountably provided within the device body 101. The shape and others of the waste receiving box 106 are not particularly limited as long as it can receive the sheet wastes. For example, the waste receiver may be a vessel with rigidity or a vessel using a film-like sack.

Figure 4B:
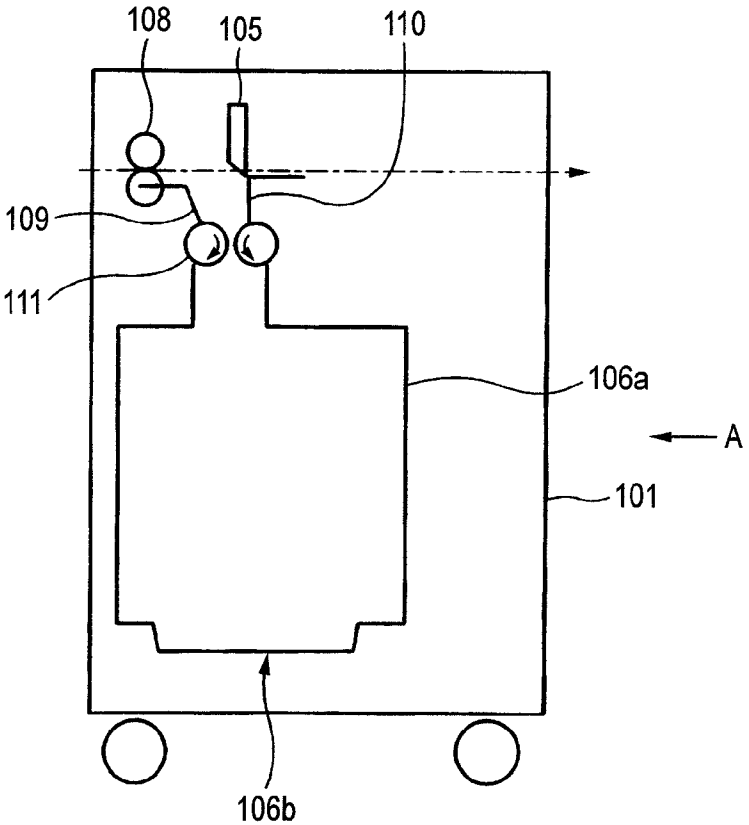
FIGS. 4A and 4B are views for explaining a cutting device according to the embodiment.
Figure 4A:
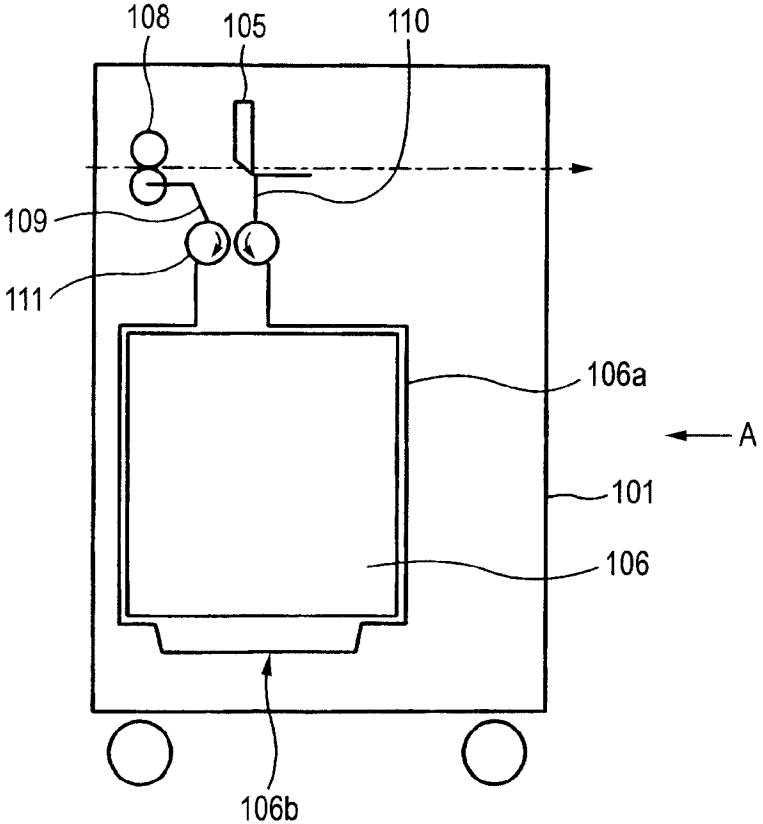
Figure 5:
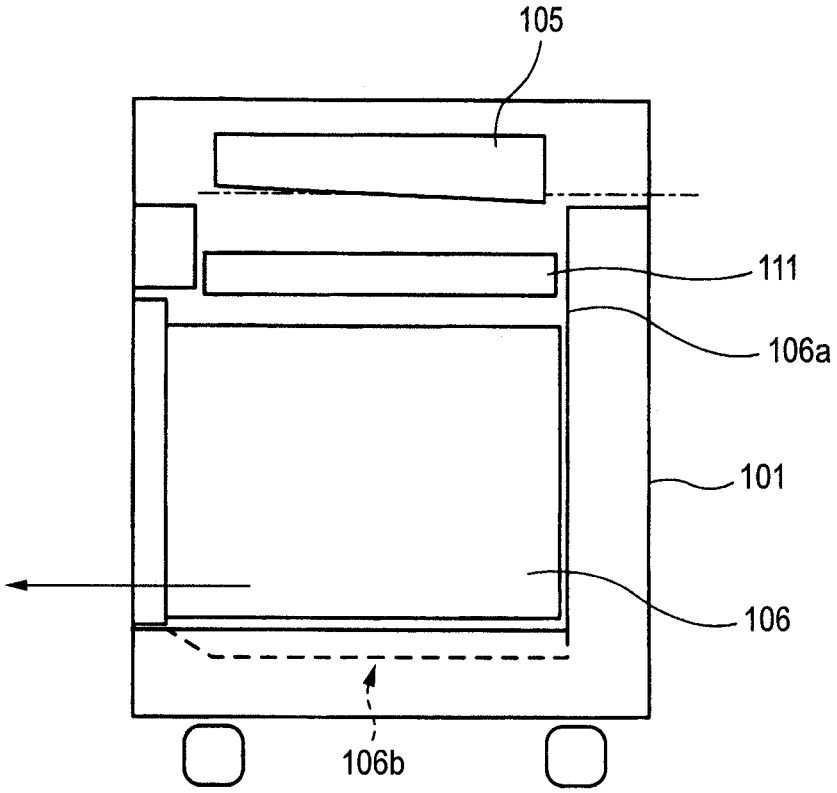
FIG. 5 is a sectional view in FIG. 4A.

In particular, the cutting device 100 in this embodiment is structured as shown in FIGS. 4A and 4B. Now, FIG. 4A shows a stage in which the waste receiving box 106 is mounted at a setting position within the device body 101. FIG. 4B is a stage in which the waste receiving box 106 has been removed from the device body 101 (moved at a non-setting position). FIG. 5 is a view seen from the direction of an arrow A in FIGS. 4A and 4B. FIG. 5 shows the cutting device 100 in an intermediate stage between FIGS. 4A and 4B, i.e. the intermediate stage in the process in the waste housing 106 is removed from the device body 101 (the stage moving from the setting position).

Within the device body 101 of the cutting device 100 in this embodiment, an inlet roll 108 is provided where the sheet bundle in the booklet form transported from the post processing device 70 side is transported into the device body 101. Between the inlet roll 108 and the knife 105, guide members 109, 110 for guiding the sheet wastes generated owing to cutting by the knife 105 to the waste receiving box 106 are provided. Further, below the guides 109, 110, a pair of rolling members 111 for transporting the sheet wastes guided by the guides 109, 110 to the sheet waste transporting box 106 are provided so as to roll in directions of arrows. The rolling members 111 serve as a transporting/guarding member in this embodiment.

Further, the waste receiving box 106 is provided so that it can be pulled out from a receiver 106*a* within the device body 101 (for example, in FIG. 4A, pulled out toward this side of the figure). Particularly, in this embodiment, on the lower side of the receiver 106*a*, i.e. on the bottom side of the waste receiving box 106, a concave area 106*b* is formed so that when the waste receiving box 106 is mounted in the receiver 106*a* (at a setting position), a space is kept between the receiver 106*a* and the waste receiving box 106.

FIG. 5 is a sectional view when seen from the side in FIG. 4A. The sheet wastes generated owing to cutting by the knife 105 are housed, as they are, into the waste receiving box 106 through the rolling members 111.

Figure 6A:
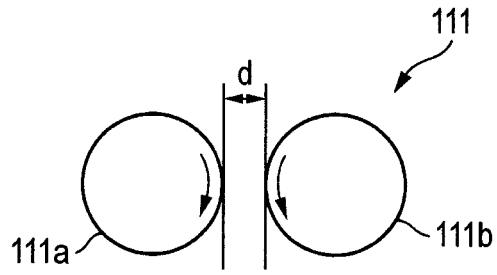
FIGS. 6A to 6C are views for explaining transporting/guarding member according to the embodiment.

As for the rolling members 111 in this embodiment, as seen from FIG. 6A, two members 111*a*, 111*b* are arranged apart from each other by a predetermined gap. This gap d is kept with a narrow gap so that from the space side when the waste receiving box 106 at the setting position is moved, an operator's finger does not touch the knife 105. Namely, the rolling members 111 have also a guarding function. Thus, in this embodiment, the pair of rolling members 111 serve as transporting/guarding member.

In this embodiment, by arranging the rolling members 111 in this way, there can be provided a cutting device 100 in which the sheet wastes are preferably transported, invasion of the operator's finder can be prevented, and safety is also considered.

Further, as seen from FIG. 2, on the downstream side of the cutting device 100, a housing tray 120 for housing sheet bundles in the booklet form cutting-finished is provided so as to project nearly horizontally from the one side of the cutting device 100.

Figure 7A:
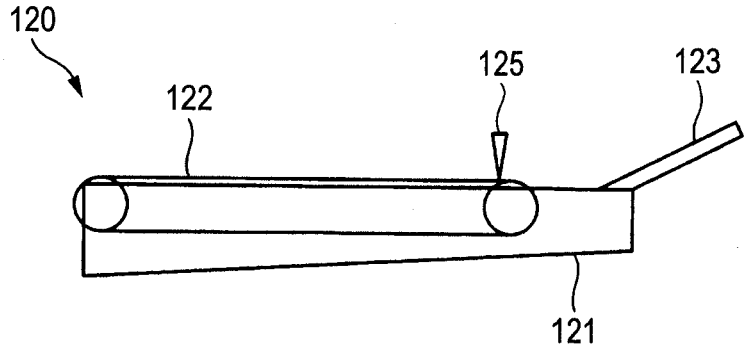
FIGS. 7A and 7B are views showing a housing tray according to the embodiment.
Figure 7B:
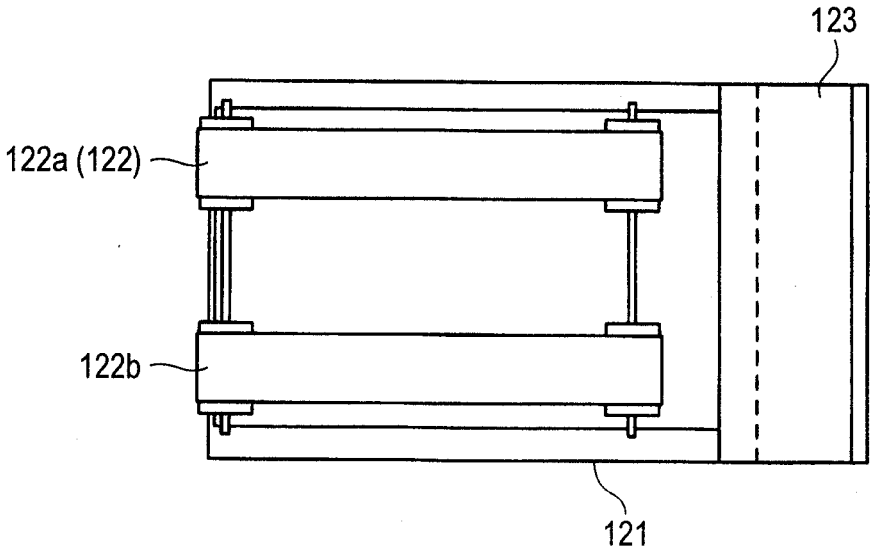

In the housing tray 120, as shown in FIGS. 7A and 7B, two sheet bundle transporting belts 122 (122*a*, 122*b*) rotatably for a supporting frame 121 are arranged in nearly parallel so as to constitute a transporting plane (along which the sheet bundle in the booklet form is transported) projecting upward from the supporting frame 121. At the tip side (downstream side in the transporting direction) of the supporting frame 121, a slope 123 is provided which projects in a rearward sloped state from the supporting frame 121. At the slope 123, the sheet bundle transported by the sheet bundle transporting belts 122 is stopped and stacked thereon. Further, in the vicinity of the end on the downstream side of the sheet bundle transporting belts 122 at the upper position of the supporting frame 121, a full stack sensor 125 is provided for detecting the fully stacked state of the sheet bundles stacked and housed by the slope 123. Furthermore, as shown in FIG. 2, above the sheet bundle transporting belts 122, a depressing member 124 is provided for depressing the sheet bundle transported on the sheet transporting belts 122.

In this embodiment, the sheet transporting belts 122 of the housing tray 120 are drive-controlled so that the sheets bundles ejected onto the sheet bundle transporting belts 122 from the cutting device 100 are successively stacked.

An explanation will be given of the operation of the printing device having the structure as described above, mainly of the processed state of the sheets after the post-processing device 70.

In this embodiment, as shown in FIG. 2, the sheet with the image created by the digital copying machine 10 is transported to the post-processing device 70 via the inverted-transporting device 50 and sheet stand-by device 60. The sheet passed through the sheet transporting path 78 of the post-processing device 70 is transported to a center-binding device 90. The bundle of sheets lined up is center-bound and center-folded. The sheet bundle folded is transported with the fold being at the head from the ejecting roll 99 to the succeeding cutting device 100 via the belt transporting body 107.

In the cutting device 100, with the fold of the sheet bundle being positioned by the stopper 104, the sheet bundle is cut by the knife 105 so that it is cutting-finished (cut-end finished) to have a predetermined length.

Figure 8A:
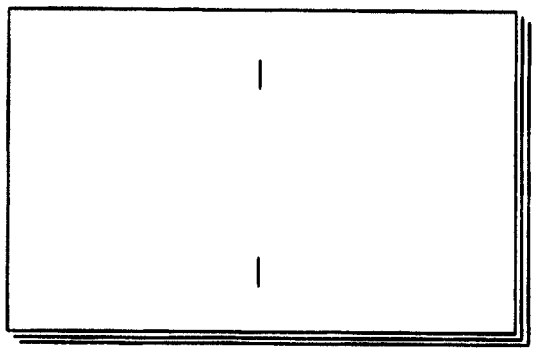
FIG. 8 is a view for explaining changes in a sheet bundle according to the embodiment.
Figure 8B:
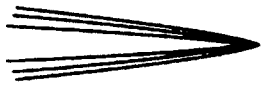
Figure 8C:
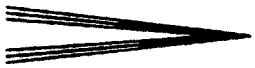

The sheets in such a process until the cutting change as shown in FIGS. 8A to 8C. Specifically, as shown in FIG. 8A, the plural sheets lined up become the sheet bundle center-bound in the post-processing device 70. The sheet bundle center-folded within the same post-processing device 70 becomes the shape as shown in FIG. 8B. At this time, the length of the sheet bundle folded is different between its internal side and the external side (surface side). So, the lengths at the end of the sheet bundle at the center-folded stage are not uniform. By cutting-finishing the non-uniform portion using the cutting device 100, the finished state with the lengths at the end aligned can be obtained as shown in FIG. 8C.

The sheet bundles cutting-finished by the cutting device 100 are successively ejected to the housing tray 120. In this case, since the sheet bundle transporting belts 122 of the housing tray 120 are drive-controlled so as to move at a predetermined timing, the sheet bundles on the sheet bundle transporting belts 122 are ejected so that a succeeding sheet bundle is stacked on at a part of the sheet bundle earlier ejected. The sheet bundles stacked are successively transported toward the slope 123 by the transporting force of the sheet bundle transporting belts 122. The sheet bundles are successively dammed by the slope 123 so that the succeeding sheet bundles are stacked in their raised state. When the sheet bundles exceed the full stack sensor 125, housing of the sheet bundles into the housing tray 120 is stopped.

Figure 9A:
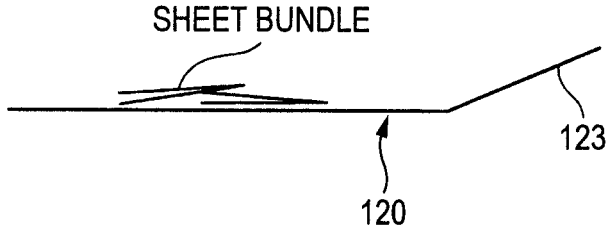
FIGS. 9A to 9C are views for explaining the manner of the sheet bundle on the housing tray according to the embodiment.
Figure 9B:
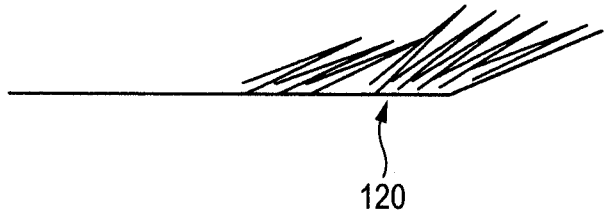
Figure 9C:
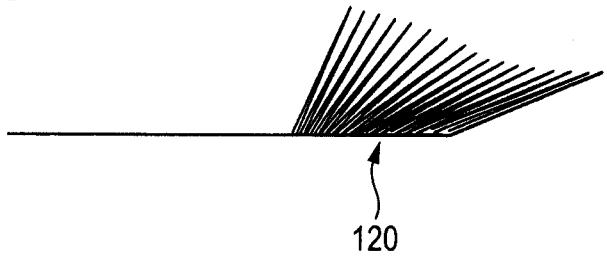

FIGS. 9A to 9C show the stacked state of the sheet bundles in the housing tray 120. As shown in FIG. 9A, as regards the sheet bundles on the housing tray 120, the succeeding sheet bundle is partially stacked on the preceding sheet bundle. The sheet bundles successively stacked, as they are, are transported toward the slope 123 within the housing tray 120. When the sheet bundle at the head reaches the slope 123, since the slope 123 is angled at a predetermined angle, the sheet bundle suffers the transporting force given by the sheet bundle transporting belts 122 and friction force at the area where the sheet bundle itself come in contact with. Thus, the sheet bundles slide on the slope 123 and are lined up with their fold oriented upward. The succeeding sheet bundle is also influenced by the preceding sheet bundle so that the sheet bundles are lined up in a direction standing with their fold oriented upward. Thus, the sheet bundles successively lined up as shown from FIG. 9B to FIG. 9C. When it is detected by the full stack sensor 125 (see FIG. 7) that the sheet bundles are fully stacked on the housing tray 120, a message display may be made by, for example, an operation unit of the digital copying machine 10 so that an operator is urged to take out the sheet bundles lined up from the housing tray 120.

On the other hand, the sheet wastes generated owing to cutting by the cutting device 100, as shown in FIG. 4A, are downward transported by the rotating force of the rolling members 111 from the guides 109, 110 through between the pair of rolling members 111 (concretely, 111*a* and 111*b* in FIG. 6 and housed into the waste receiving box 106.

At this time, since the rolling members 111 are rotating, the sheet wastes can be preferably transported.

The rotation of the rolling members 111 may be stopped, for example, at the stage when the waste receiving box 106 has been moved from the receiver 106*a* within the device body 101 of the cutting device 100. However, in this embodiment, also when the waste receiving box 106 has moved, the rolling members 111 continue to rotate, as they are, so that the sheet wastes can be housed in the concave area 106*b* formed below the waste receiving box 106. For this reason, also in disposing of the sheet wastes in the waste receiving box 106, it is not necessary to stop the operation of the cutting device 100, thereby restraining degradation in the productivity of the cutting device 100. The concave area 106*b* may be cleaned by in the manner of, for example, scratching out the sheet wastes housed in the concave area 106*b* with a hand. Even if such a manner is adopted, since safety is assured, a particularly problematic situation does not occur.

In this embodiment, the gap d (see FIG. 6A) between the pair of rolling members 111 was fixed using the pair of rolling members 111 serving as the transporting/guarding member (concretely, 111*a*, 111*b*). However, for example, at the stage when the waste receiving box 106 is mounted, a gap wider than this gap d may be given. Further, when the waste receiving box 106 has been moved from the receiver 106*a*, the gap d may be lost (the rolling members 111 are brought into contact with each other). Furthermore, the rolling members 111 may be brought into contact with each other from the beginning as long as the sheet wastes are transported.

Further, a guide may be located at the position opposite to a single rolling member 111 adopted as the transporting/guarding member so that the space between the single rolling member 111 and the guide serves as a route for transporting the sheet wastes. In this case, as the guide, a dedicated guide may be provided, or otherwise, for example, a frame of the device body 101 may be used.

In this embodiment, the pair of rolling members 111 as shown in FIG. 6A were employed as the transporting/guarding member. However, the members as shown in FIG. 6B or 6C may be employed.

Figure 6B:
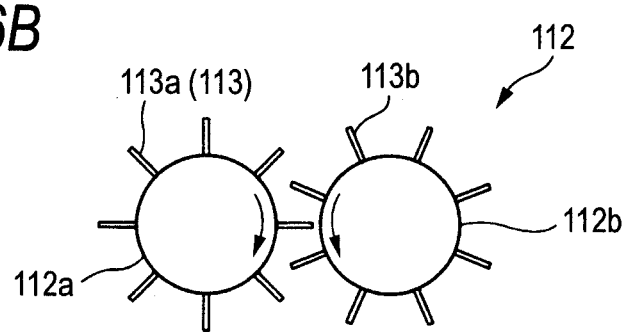

The transporting/guarding member shown in FIG. 6B is a pair of rotating members 112 (112*a*, 112*b*) each with a plural projections 113 (113*a*, 113*b*) formed on the surface. By using these rotating members 112, the space between the projections 113 can be lost, and while the sheet wastes are transported, these projections 113 can improve the transportability, thereby providing the transporting/guarding member in which the transportability of the sheet wastes and the safety are taken into consideration. In this case, the material of the projections 113 should not be limited, but is preferably rubber with high hardness according to the deformation of the sheet wastes and from the viewpoint of safety.

Further, the rotating members 112 may be formed in either a roll-shape or belt-shape. Moreover, the pair of rotating members 112 is provided so that they can be brought into contact with or separation from each other. Particularly, if the rotating members 112 are adapted to be brought into contact with each other, the guarding function by the transporting/guarding member can be further enhanced. Furthermore, the rotating members 112 provided with the projections may be realized, for example, in such a manner that the projections are formed on the surface of the rolling member or belt member, or a paddle-like manner.

Figure 6C:
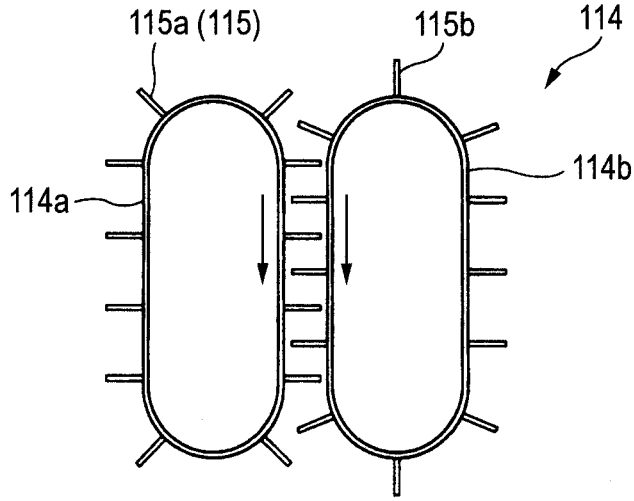

Further, the transporting/guarding member shown in FIG. 6C is composed of a pair of belt members 114 (114*a*, 114*b*) with a plural projections 115 (115*a*, 115*b*) formed on the surface. Using these belt members 114, the same advantage as in FIG. 6B can be obtained.

As understood from the description hitherto made, in this embodiment, upon housing the sheet wastes generated in the cutting device 100 to the waste receiving box 106, since the transporting/guarding member is provided between the knife 105 and the waste receiving box 106, both functions of the transportability of the sheet wastes and the safety can be satisfied.

Additionally, such application of the transporting/guarding member to the cutting device 100 means that they can be also applied to the manner of sheet processing in e.g. a puncher or stapler. In such a case also, the transporting/guarding member may be employed.

Further, in this embodiment, the digital copying machine 10 was employed as the image forming unit. Without being limited to it, a printer may be employed. In this embodiment, although a monochromatic image was created by the digital copying machine 10, it is needless to say that a color image may be created.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A sheet waste processing device comprising:

a sheet processing tool that separates a sheet into pieces, at least one of said pieces being waste;

a waste receiver that is movable between a receiving position located under the sheet processing tool where the waste generated by the sheet processing tool is received by the waste receiver and a disposing position which is not located under the sheet processing tool where the waste received by the waste receiver can be disposed of; and a transporting/guarding member that is provided between the sheet processing tool and the waste receiver, transports the waste into the waste receiver located at the receiving position, and blocks direct touching of the sheet processing tool from a waste receiver space, wherein the transporting/guarding member comprises at least a pair of rotating members, and the waste is transported through a space between the rotating members, wherein each rotating member of the pair of rotating members has a plurality of projections on the peripheral surface thereof; and the pair of rotating members separate from each other when the waste receiver is located at the receiving position, and the pair of rotating members come into contact with each other when the waste receiver moves to the disposing position.

2. The sheet waste processing device as claimed in claim 1, wherein the transporting/guarding member transports the waste generated by the sheet processing tool in a vertical direction.

3. The sheet waste processing device as claimed in claim 1, further comprising:

an auxiliary waste receiver that receives the waste in response to the waste receiver being moved to the disposing position.

4. The sheet waste processing device as claimed in claim 3, wherein the auxiliary waste receiver is located below the waste receiver when the waste receiver is located at the receiving position.

5. The sheet waste processing device as claimed in claim 1, wherein the sheet processing tool includes a cutting unit.

6. An image forming apparatus comprising:

an image forming unit that forms an image on the sheet; and the sheet waste processing device according to claim 1 that processes the sheet with the image formed thereon.

* * * * *